US005775201A

United States Patent [19]

Tanji et al.

[11] Patent Number: 5,775,201

[45] Date of Patent: Jul. 7, 1998

[54] PISTON ARRANGEMENT FOR A PERCUSSION TOOL

[75] Inventors: Isamu Tanji; Yoshinori Ishizawa, both of Hitachinaka, Japan

[73] Assignee: Hitachi Koko Co., Ltd., Tokyo, Japan

[21] Appl. No.: 521,755

[22] Filed: Aug. 31, 1995

[30] Foreign Application Priority Data

Oct. 14, 1994 [JP] Japan ..... 6-249783

[51] Int. Cl.[6] ..... F01B 11/02

[52] U.S. Cl. ..... 92/85 R; 92/172; 277/165; 277/188 R; 277/188 A

[58] Field of Search ..... 277/165, 168, 277/188 A, 188 R; 92/193, 194, 196, 240, 172, 249, 250, 85 R

[56] References Cited

U.S. PATENT DOCUMENTS

| | | | |
|---|---|---|---|
| 2,437,814 | 3/1948 | Hallen | 277/168 |
| 2,747,954 | 5/1956 | Damm et al. | 277/188 R |
| 2,973,978 | 3/1961 | Oppenheim | 277/188 A |
| 3,582,093 | 6/1971 | Lucien | 277/188 R |
| 4,052,112 | 10/1977 | Faber | 277/188 A |
| 4,928,577 | 5/1990 | Stoll | 92/192 |
| 5,113,747 | 5/1992 | Pignerol | 92/250 |

FOREIGN PATENT DOCUMENTS

| | | | |
|---|---|---|---|
| 1557910 | 2/1969 | France | 277/188 A |

*Primary Examiner*—Thomas E. Denion
*Attorney, Agent, or Firm*—Pollock, Vande Sande & Priddy

[57] ABSTRACT

A percussion tool comprises a cylinder 3 communicated to a pressure accumulating chamber 16 storing pressurized air therein, and a piston 4 slidable in the cylinder 3 when pressurized air is introduced into the cylinder 3 from the pressure accumulating chamber 16 and pressure of the introduced air is applied on the piston 4. A circular groove 6 is recessed on a peripheral surface of the piston 4, the peripheral surface adjacently facing to an inside wall of the cylinder 3. A piston ring 10 is accommodated in the circular groove 6, so as to provide a hermetical sealing between the piston 4 and the cylinder 3. And, a ring bumper 11 made of resilient member is provided in the circular groove 6 adjacent to the piston ring 10 in a sliding direction of the piston 4.

15 Claims, 8 Drawing Sheets

PISTON ARRANGEMENT FOR A PERCUSSION TOOL

BACKGROUND OF THE INVENTION

1. Field of the Invention

This invention relates to a piston arrangement for a percussion tool utilized for hitting a nail or the like into a wood or the like using a power source of pressurized air.

2. Prior Art

FIG. 7 shows a conventional percussion tool disclosed, for example, in the unexamined Japanese utility model application No. 63-186571/1988 or in the unexamined Japanese utility model application No. 2-23970/1990, each assigned to the same applicant as this application. As shown in the drawing, the percussion tool generally comprises a pressure chamber 16 for accumulating pressurized air therein, and a trigger 2 manually operable for controlling a control valve 22. A head valve 5, disposed at the top of a cylinder 3, is opened in response to the actuation of the control valve 22, so that the pressurized air is introduced from the pressure chamber 16 into the upper space of a piston 4 slidable in the cylinder 3. Thus, the piston 4, upon receiving the pressure of pressurized air at the top thereof, is quickly lowered along the inside wall of the cylinder 3. A driver 18, integral with the piston 4 and accommodated centrally in the cylinder 3 so as to extend in the axial direction thereof, transmits an impact force to a fastener, such as a nail, which is loaded in an injection hole 17 of a blade guide 9 in advance. The impact force applied to the nail in this case is generally so much larger that the nail is completely hit into a wood or the like by one stroke.

The piston 4, generally made of aluminum or the like material, faces to the inside wall of the cylinder 3 at its cylindrical periphery, on which a circular groove 6 is formed for accommodating a piston ring 10 therein, as shown in FIG. 8. An O-ring 21 is also housed in the circular groove 6, being located at the inside of the piston ring 10. The O-ring 21 resiliently presses the piston ring 10 outward so that the outer periphery of the piston ring 10 is brought into contact with the inside wall of the cylinder 3, thereby maintaining a hermetical seal between the piston 4 and the cylinder 3 when the piston 4 slides along the inside wall of the cylinder 3.

The piston ring 10, made of plastic or the like material, has a diameter smaller than the outer diameter of the piston 4 and is an open ring having a cutout so as to allow the shape of the piston ring 10 to be flexibly deformed. Thus, the piston ring 10 is easily coupled into the circular groove 6, causing an elastic deformation. Furthermore, due to such flexibility of the piston ring 10, the shape of the piston ring 10 is precisely fitted to the cylindrical shape of the cylinder 3, when pressed outward by the O-ring 21.

The vertical width of the groove 6 is sufficiently large, so that the piston ring 10 is easily coupled into the groove 6 due to presence of a vertical clearance 25 provided between the piston ring 10 and the groove 6. The vertical clearance 25 has a size enough to allow the piston ring 10 to freely shift along and be pressed against the inside wall of the cylinder 3.

The piston ring 10 is made of a plastic material comprising polyimide group resin whose limit PV value is not smaller than approximately 50 $Kg/cm^2 \times m/s$, so as to be durable against the sliding abrasion and lubricative enough not to damage the inside wall of the cylinder 3 made of aluminum or plastic, while maintaining an appropriate hermetical sealing condition on the sliding surface.

FIG. 8 shows the piston ring 10 lowering in the cylinder 3. The piston ring 10, being pressed by the O-ring 21 outward, receives a tension acting toward the inside wall of the cylinder 3. Thus, a frictional force is caused between the piston ring 10 and the inside wall of the cylinder 3. Compared with the piston 4 abruptly lowering upon receiving the pressure of pressurized air, the piston ring 10 has a smaller area to be subjected to such a pressure. Thus, the piston ring 10 is stationarily positioned at the upper side in the groove 6.

After the piston 4 hammered the nail into the wood or the like member, the piston 4 suddenly collides with and is stopped by a piston bumper 7 made of rubber. In response to collision of the piston 4 with the piston bumper 7, the piston ring 10 is subjected to a so sudden and large inertia moment that the piston ring 10 shifts downward across the tiny clearance 25 and strongly hits the lower surface of the groove 6 (i.e. the piston 4) which is made of a rigid material. Accordingly, the piston ring 10 receives a large impact force every time the piston 4 hits the piston bumper 7 in an operation of hammering the nail into a wood or the like.

FIG. 10 shows another conventional percussion tool, for example, disclosed in the unexamined Japanese patent application No. 2-172682/1990 assigned to the same applicant as this application. This percussion tool comprises a reciprocating valve 23 which controls the opening and closing of the head valve 5 in such a manner that the piston 4 repetitively reciprocates in an up-and-down direction in the cylinder 3 when the trigger 2 is depressed for operating the control valve 22, thereby realizing the multiple hammering operation. Other construction details are substantially the same as that of the FIG. 7 apparatus.

FIG. 12 shows still another conventional percussion tool, for example, disclosed in the unexamined Japanese patent application No. 5-16077/1993 assigned to the same applicant as this application. This percussion tool is different in that the piston 4 is lowered in a stepwise manner by repeating the opening and closing of the head valve 5 in response to each operation of the trigger 2, thereby realizing the multiple hammering operation.

These multiple-stroke percussion tools enable us to completely hit a relatively long nail into a wood or the like with a relatively small power.

The piston ring 10 disclosed in FIG. 9 is made of plastic comprising polyimide group resin, which is durable against abrasion and requires less lubricant oil supply compared with the O-ring 21. The plastic containing polyimide group resin as a chief component or as part thereof is roughly separated into two types, i.e. non-thermoplastic type and thermoplastic type. The non-thermoplastic type is of course superior to the thermoplastic type against heat, and therefore has a higher limit PV value which indicates an excellent anti-abrasion property under severe frictional heat circumstances generated by the sliding movements of the piston 4. However, the non-thermoplastic type piston ring is approximately ten times as expensive to produce as the O-ring because it cannot be made by the conventional injection molding.

Thus, in order to reduce the cost, the piston ring 10 is generally made of a cheaper thermoplastic material producible by injection molding. The carbon amount contained in the plastic is usually increased as highly as possible to increase the limit PV value for realizing an excellent anti-abrasion property comparable with the non-thermoplastic type. However, increasing the amount of carbon raises the hardness of resin itself, and has poor durability against an impact force. Thus, the piston ring may be damaged by collision when it receives a large inertia or impact force when the piston is abruptly stopped.

According to the single-stroke percussion tool disclosed in FIG. 7, the piston 4 moves quickly when it completely hits a nail into a wood by one stroke, and then the piston 4 collides with the piston bumper 7. The piston bumper 7, when it collides with the piston 4, causes an elastic deformation so as to absorb the impact force given from the piston 4 and resiliently stops the piston 4. The piston ring 10 receives an inertia moment in response to the stoppage of the piston 4, and thus shifts across the clearance 25 and collides with the rigid piston 4. The impact force acting on the piston ring 10 in this moment is not so large because of the shock absorbing effect of resiliently stopping the piston 4 on the piston bumper 7.

However, in the case of the multi-stroke percussion tool, the piston 4 is stopped several times at intermediate portions of the cylinder 3 before finally colliding with the piston bumper 7, being resisted by a reaction force from the nail 14, as shown in FIG. 11. Thus, the piston 4 of the multi-stroke percussion tool is subjected to an impact force many times without an aid of shock absorbing effect given by the resilient piston bumper 7.

The piston ring 10, being pressed outward by the O-ring 21, receives a tension acting toward the inside wall of the cylinder 3. Thus, a frictional force is caused between the piston ring 10 and the inside wall of the cylinder 3. Compared with the piston 4 abruptly moving downward upon receiving a large pressure of pressurized air, the piston ring 10 has a smaller area to be subjected to such a pressure. Thus, the piston ring 10 is stationarily positioned at the upper side in the groove 6.

Accordingly, when the piston 4 is abruptly stopped, the piston ring 10 shifts so quickly from the upper side to the lower side in the groove 6 by receiving an inertia moment. Thus, the piston ring 10 hardly collides with the lower surface of the groove 6, i.e. the rigid surface of the aluminum piston 4, receiving a large impact force.

The impact force in this case is so large that the piston ring 10 may be damaged even if it is made of non-thermoplastic polyimide group resin. Furthermore, the piston ring 10 is opened at the cutout portion; thus, the piston ring 10 tends to cause vibration in the vicinity of this cutout portion, possibly leading to damage of the piston ring 10. To suppress such vibrations, it may be possible to increase the cross-sectional area of the piston ring 10. However, increasing the cross-sectional area of the piston ring 10 will result in an increase of weight or inertia of the piston ring 10, causing the necessity of increasing the durability of the piston ring 10 against thus increased weight or inertia.

In general, for percussion tools, being light in weight is preferable for handiness in operation. To realize the reduction of an overall weight of the percussion tool, it is essentially important to reduce the weight of piston. If a light-weight piston is used, the piston speed will be fairly increased. Thus, the piston ring must survive such an increased piston speed. In other words, the durability of the piston ring is the key for realizing reduction of light-weight piston.

SUMMARY OF THE INVENTION

Accordingly, in view of above-described problems encountered in the prior art, a principal object of the present invention is to provide a percussion tool having a piston arrangement capable of providing an excellent durability for a sealing member such as a piston ring.

In order to accomplish this and other related objects, a first aspect of the present invention provides a piston apparatus for a percussion tool comprising: a piston slidable in a cylinder of the percussion tool; a groove recessed on a peripheral surface of the piston; a sealing member accommodated in the groove; and a bumper provided in the groove adjacently to the sealing member in a sliding direction of the piston.

Furthermore, a second aspect of the present invention provides a piston apparatus for a percussion tool comprising: a piston slidable in a cylinder of the percussion tool; a groove recessed on a peripheral surface of the piston, the peripheral surface being capable of adjacently facing to an inside wall of the cylinder; a piston ring accommodated in the groove, the piston ring being capable of providing a hermetical sealing between the piston and the inside wall of the cylinder when the piston is installed in the cylinder; and a bumper provided in the groove adjacently to the piston ring in a sliding direction of the piston.

Moreover, a third aspect of the present invention provides a percussion tool comprising: a cylinder communicated to a pressurized air supply means; a piston slidable in the cylinder when pressurized air is introduced into the cylinder from the pressurized air supply means and pressure of the pressurized air is applied on the piston; a groove recessed on a peripheral surface of the piston, the peripheral surface facing to an inside wall of the cylinder; a piston ring accommodated in the groove, so as to provide a hermetical sealing between the piston and the cylinder; and a bumper provided in the groove adjacently to the piston ring in a sliding direction of the piston.

In the above piston apparatus or percussion tool, it is preferable that the sealing member (i.e. piston ring) is made of plastic, and the bumper is made of a resilient member such as rubber.

More specifically, the bumper is disposed at one side of the sealing member (i.e. piston ring) in the sliding direction of the piston. Alternatively, the bumper can be disposed at both sides of the piston ring in the sliding direction of the piston so as to surround the sealing member (i.e. piston ring).

In accordance with the above arrangement of the present invention, even if a piston ring is subjected to an excessive impact force due to an inertia moment acting when the piston abruptly stops in the percussion operation, such an excessive impact force can be absorbed by the resilient bumper disposed adjacently to the piston ring, thereby preventing the piston ring from being damaged.

BRIEF DESCRIPTION OF THE DRAWINGS

The above and other objects, features and advantages of the present invention will become more apparent from the following detailed description which is to be read in conjunction with the accompanying drawings, in which.

DETAILED DESCRIPTION OF THE PREFERRED EMBODIMENTS

Figure 1:
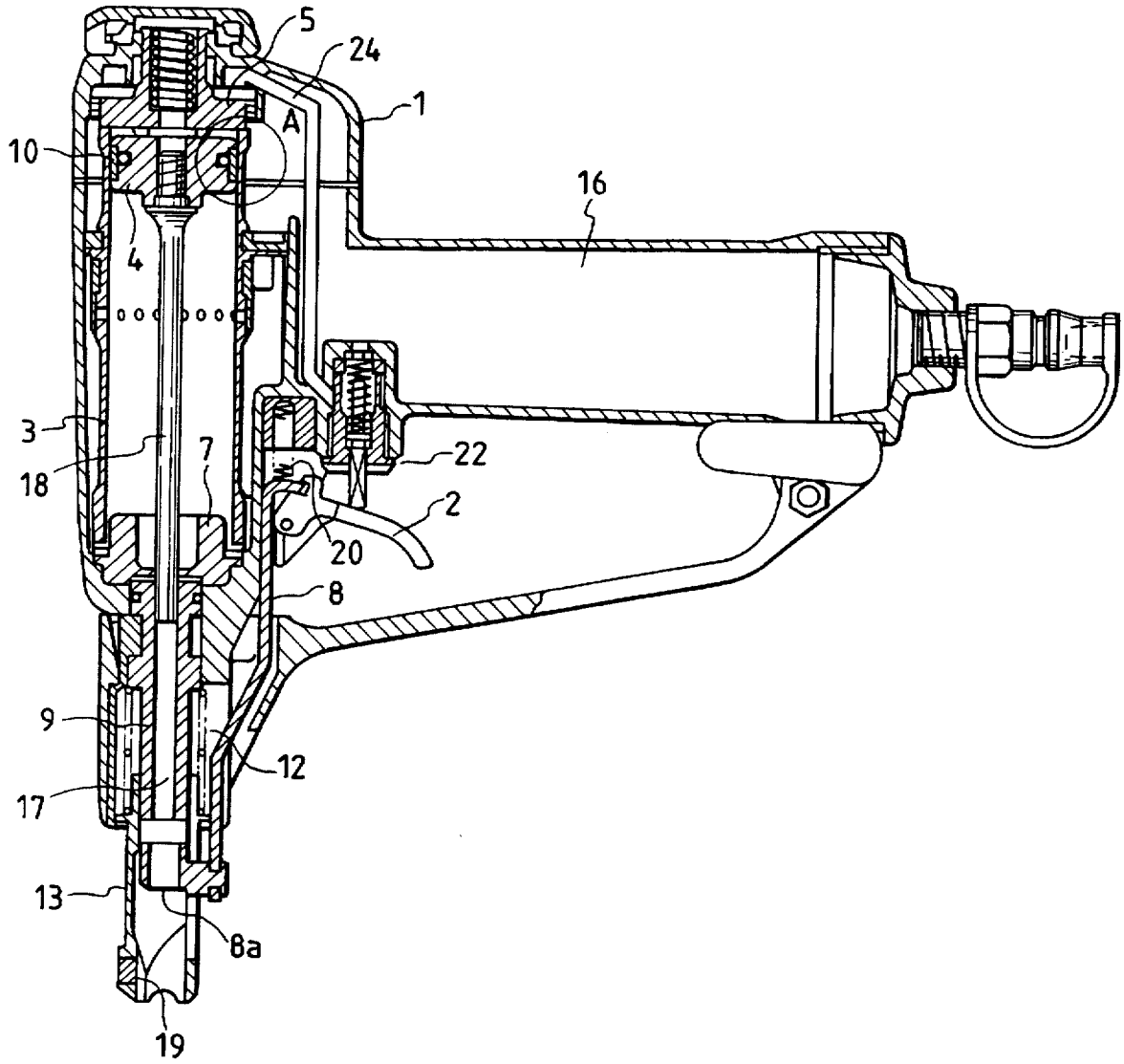
FIG. 1 is a cross-sectional side view showing an arrangement of a percussion tool in accordance with a first embodiment of the present invention.

Preferred embodiments of the present invention will be explained in greater detail hereinafter, with reference to the accompanying drawings. Identical parts are denoted by identical reference numerals throughout the views.

FIG. 1 is a multi-stroke percussion tool in accordance with a first embodiment of the present invention. A percussion tool body 1 has a pressure accumulating chamber 16 into which pressurized air is supplied from a compressor (not shown). The percussion tool body 1 comprises a control valve 22 which controls the opening and closing of a head valve 5, an air passage 24 communicating the control valve 22 to the head valve 5, a trigger 2 which opens or closes the control valve 22, and a piston 4 slidably accommodated in a cylinder 3 and integrally connected to a driver 18 extending in an axial direction of the cylinder 3.

Figure 2:
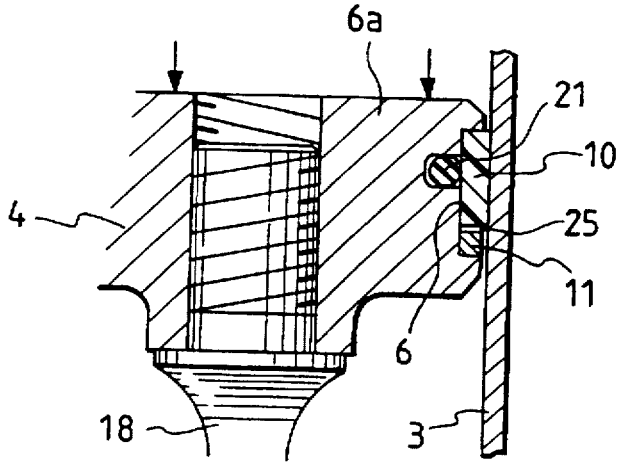
FIG. 2 is a cross-sectional view enlargedly showing a portion "A" of FIG. 1.

The piston 4, made of aluminum or the like, is provided with a circular groove 6 at its periphery adjacently facing to the inside wall of the cylinder 3. A piston ring 10 is coupled into the circular groove 6. An O-ring 21 is accommodated in a small and deep groove 6a provided centrally in and continuous to the circular groove 6, so that the O-ring 21 is disposed at an inner side of the piston ring 10 and resiliently pushes the piston ring 10 outward. Thus, the outer periphery of the piston ring 10 is urged against and is brought into contact with the inside wall of the cylinder 3, thereby maintaining a hermetical sealing condition of a sliding surface between the piston 4 and the cylinder 3, as shown in FIG. 2.

Figure 9:
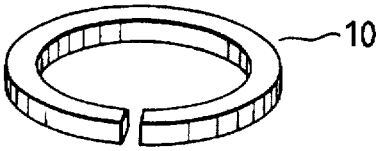
FIG. 9 PRIOR ART
FIG. 9 is a perspective view showing one example of a piston ring shown in FIG. 8.
Figure 10:
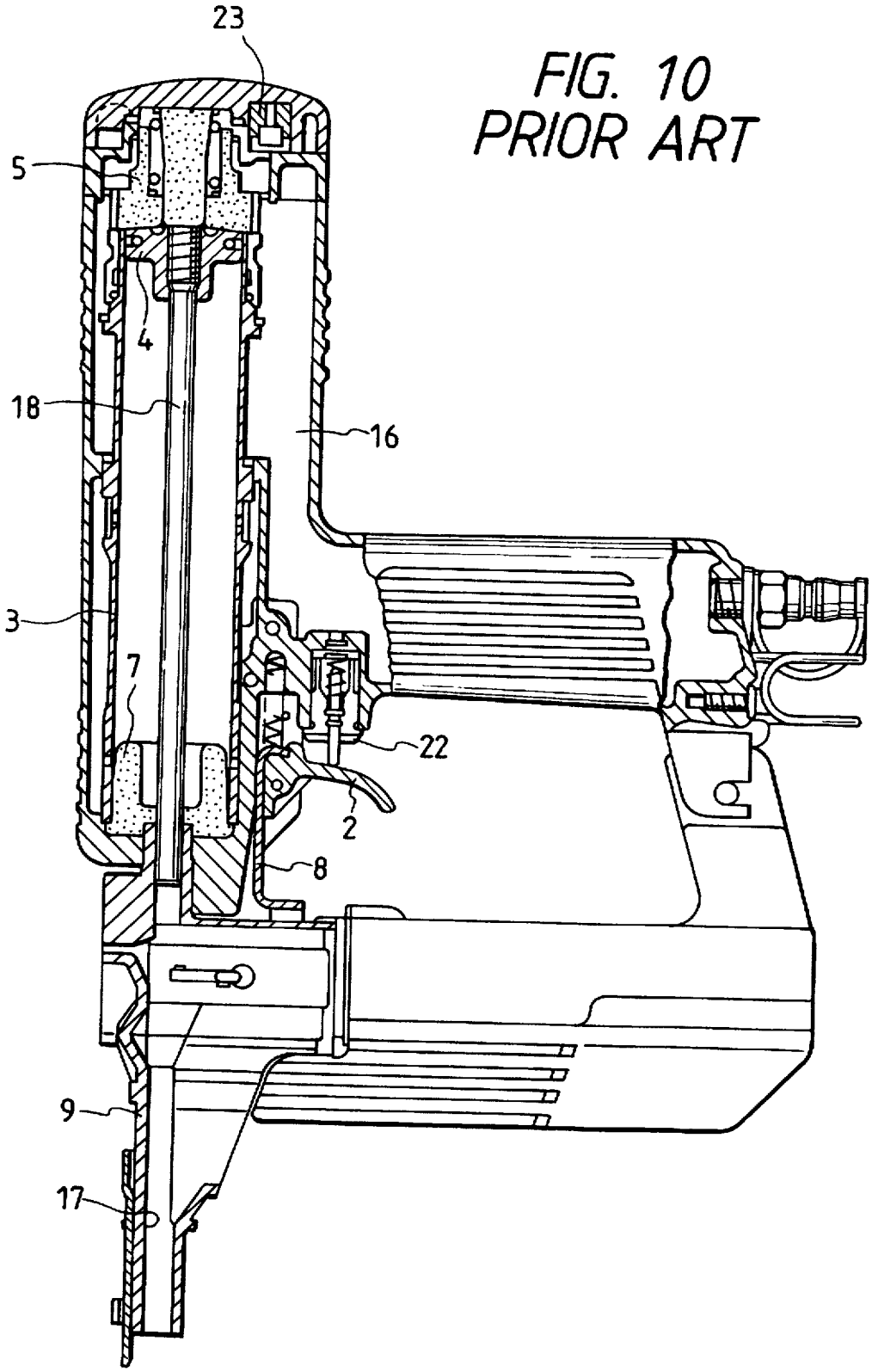
FIG. 10 PRIOR ART
FIG. 10 is a partly sectional side view showing an arrangement of another conventional percussion tool.
Figure 11:
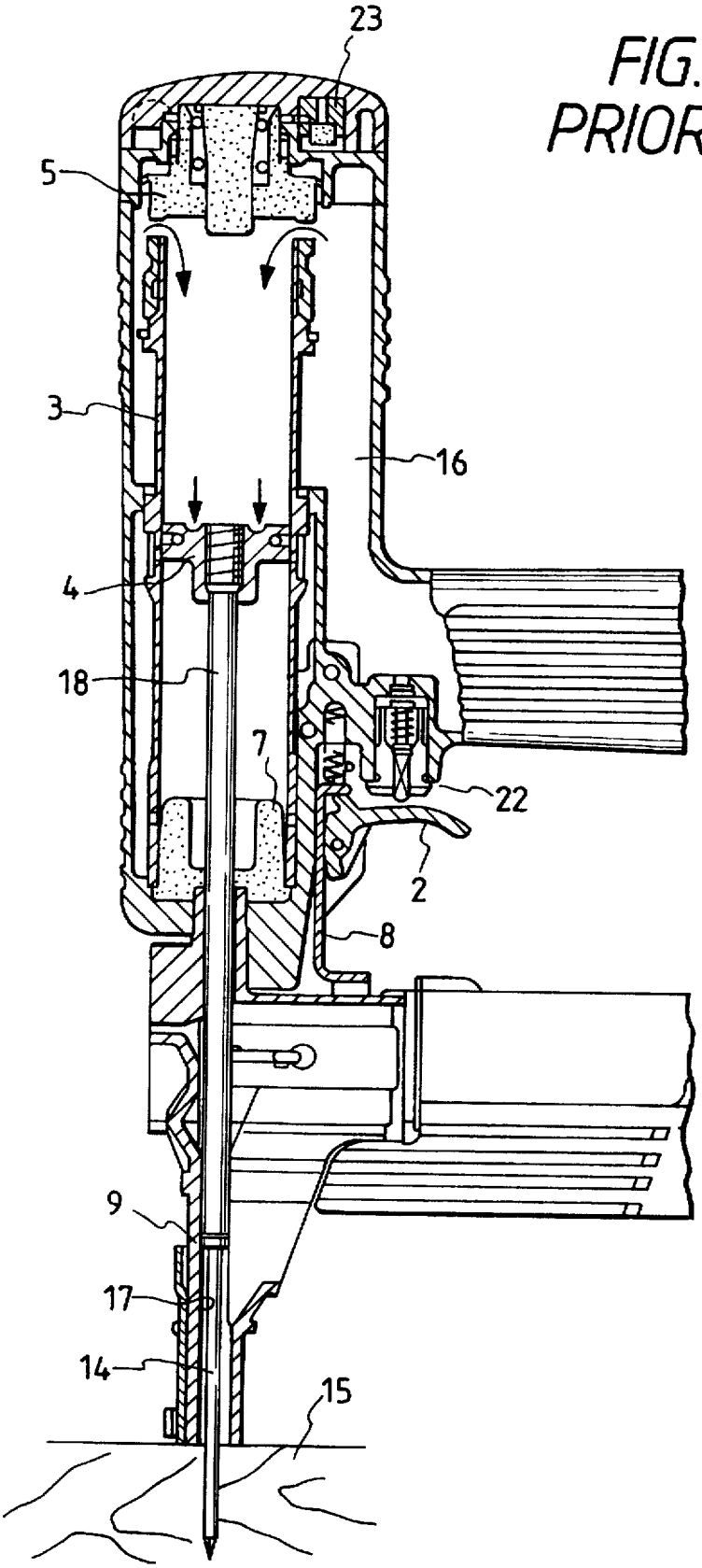
FIG. 11 PRIOR ART
FIG. 11 a partly sectional side view showing an operating condition of the conventional percussion tool shown in FIG. 10.
Figure 12:
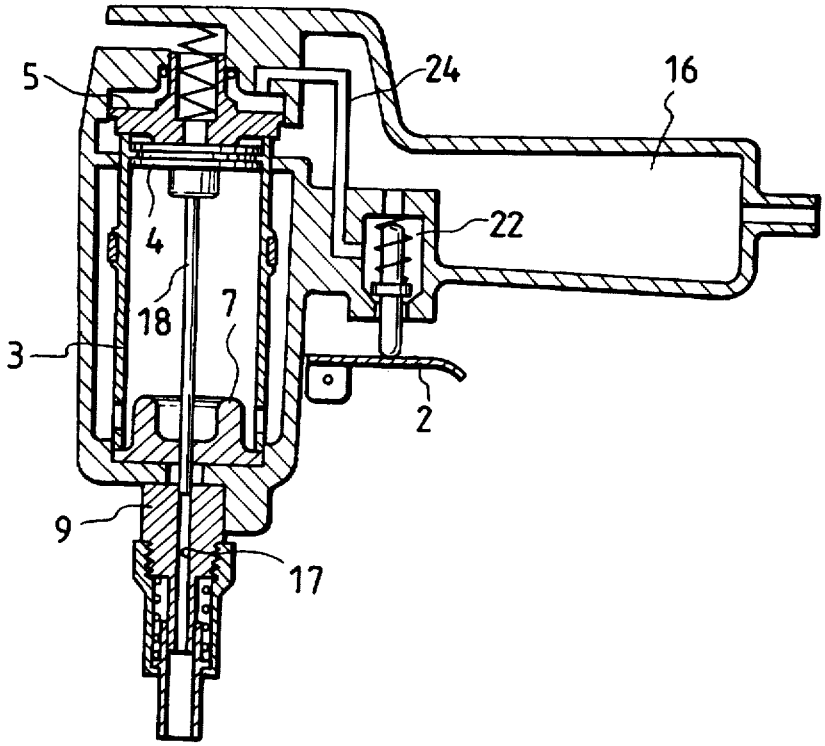
FIG. 12 PRIOR ART
FIG. 12 is a cross-sectional side view showing an arrangement of still another conventional percussion tool.

The piston ring 10 needs to be basically rigid enough to bear the compression force applied thereon by pressurized air, but is generally made of a material having a certain amount of flexibility, such as plastic. As shown in FIG. 9, the piston ring 10, having a diameter smaller than the outer diameter of the piston 4, is an open ring having a cutout so as to allow the shape of the piston ring 10 to be flexibly deformed. Thus, the piston ring 10 is readily coupled into the circular groove 6, causing an elastic deformation from its cutout portion. Furthermore, due to flexibility of the piston ring 10, the shape of the piston ring 10 is precisely fitted to the cylindrical shape of the cylinder 3, when pressed outward by the O-ring 21.

The vertical width of the groove 6 is sufficiently large enough to provide a vertical clearance 25 between the piston ring 10 and the groove 6, thereby allowing the piston ring 10 to be easily coupled into the groove 6. The vertical clearance 25 has a size enough to allow the piston ring 10 to freely shift in a vertical direction along and be pressed against the inside wall of the cylinder 3.

The piston ring 10 is made of a plastic material comprising polyimide group resin whose limit PV value is not smaller than approximately 50 $Kg/cm^2 \times m/s$, so as to be durable against the sliding abrasion and lubricative enough not to damage the inside wall of the cylinder 3 made of aluminum or plastic, while maintaining an appropriate hermetical sealing condition on the sliding surface. The plastic material having the limit PV value not smaller than approximately 50 $Kg/cm^2 \times m/s$ is, for example, ethylene tetrafluoride resin comprising polyimide group resin of not smaller than 10%, or a material comprising the polyimide group resin as a primary component.

The circular groove 6, recessed in a radial direction of the piston 4, is designed to have a radial depth just being capable of accommodating the piston ring 10 between the groove 6 and the inside wall of the cylinder 3, so as to provide a small radial clearance. Namely, the radial clearance between the groove 6 and the piston ring 10 is provided as small as possible within a predetermined range where no obstruction is caused in the sliding movement of the piston ring 10, thereby preventing the piston 4 from being inclined in a thickness direction of the piston 4.

An elastic bumper 11, made of rubber and formed into a ring shape, is provided in the circular groove 6 together with the piston ring 10 so as to be disposed beneath the piston ring 10 in the sliding direction (i.e. vertical direction) of the piston 4, as shown in FIG. 2. That is, according to the present embodiment, the space defined by the vertical clearance 25 is provided with the elastic bumper 11. The elastic bumper 11 can be made of a cheap material; thus, the cost of the bumper 11 is comparable with that of the O-ring 21 which is negligible compared with the cost of the piston ring 10.

An injection portion comprises a blade guide 9 attached to the lower part of the percussion tool body 1 and having an injection hole 17 centrally extending thereof, a nail guide 13 supported to the blade guide 9 so as to be slidable in an up-and-down direction, a spring 12 pressing the nail guide 13 downward, and a push lever 8 having a nail head guide 8a vertically shiftable along the inside wall of the nail guide 13.

The nail guide 13 has a hollow cylindrical body for guiding the shaft portion of a nail 14 and a permanent magnet 19 attached at the lower end thereof for magnetically absorbing or holding the nail 14 inserted in the nail guide 13. The push lever 8, always pushed downward by a spring 20, has an upper end engageable with the trigger 2 so as to lock the trigger 2 in an inoperable condition. The nail head guide 8a is responsive to the presence of nail 14; namely, the nail head guide 8a is pressed upward by the head of the nail 14 when the nail 14 is loaded in the nail guide 13. The push lever 8, integral with the nail head guide 8a, is lifted upward and disengaged from the trigger 2, thereby allowing the user to operate the trigger 2.

Figure 3:
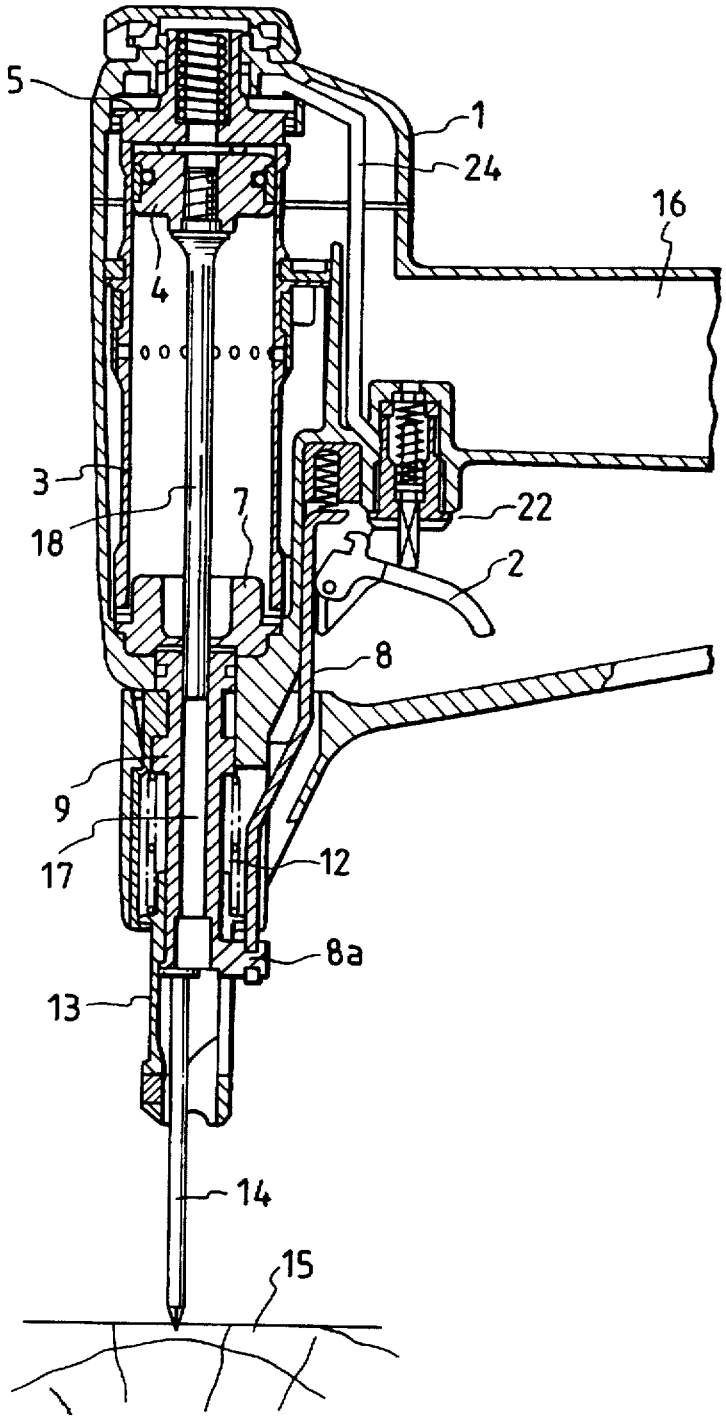
FIG. 3 is a cross-sectional side view showing one operational condition of the percussion tool in accordance with the first embodiment of the present invention, wherein a nail is loaded in a nail guide.

An operation of the above-described multi-stroke percussion tool will be explained with reference to FIGS. 2 through 4. As shown in FIG. 3, the nail 14 is inserted in the nail guide 13, and the front (lower) edge of the nail 14 is placed on the surface of a wood 15 so that the head of the nail 14 pushes the nail head guide 8a upward together with the push lever 8. Thus, the upper end of the push lever 8 is disengaged from the trigger 2, thereby releasing the lock condition of the trigger 2.

Then, the trigger 2 is operated (pulled) to push the control valve 22. Thus, the control valve 22 is opened, and pressurized air stored in the upper space of the head valve 5 is guided to the opening of control valve 22 through the air passage 24 and then leaks out of the control valve 22. Hence, the head valve 5 is raised upward so as to open the upper end of the cylinder 3. Upon opening the head valve 5, the pressurized air rushes into the cylinder 3 from the pressure accumulating chamber 16, giving a high pressure onto the piston 4. Thus, the driver 18 integral with the piston 4 moves downward quickly, hammering the nail 14 into the wood 15.

Figure 4:
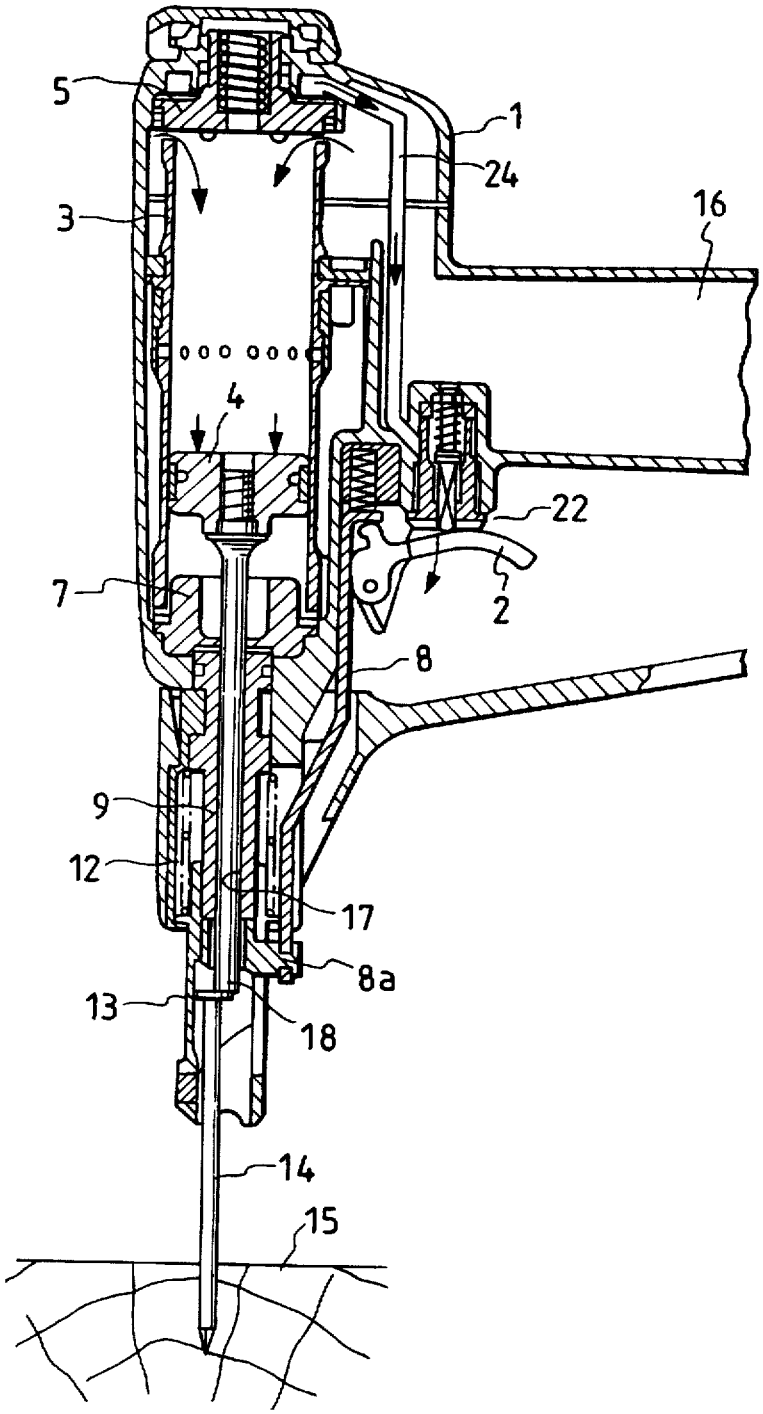
FIG. 4 is a cross-sectional side view showing another operational condition of the percussion tool in accordance with the first embodiment of the present invention, wherein the nail loaded in the nail guide is partly hit into a wood.
Figure 7:
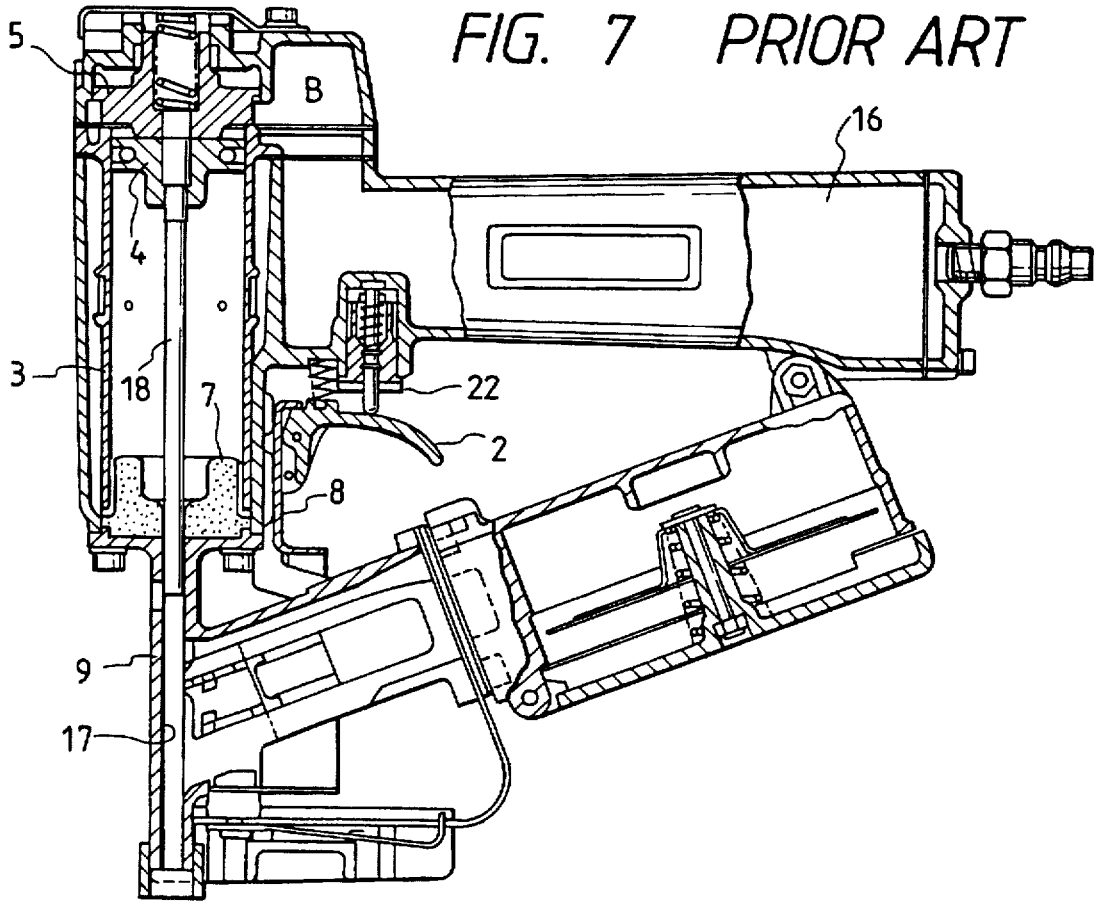
FIG. 7 PRIOR ART
FIG. 7 is a cross-sectional side view showing an arrangement of a conventional percussion tool.
Figure 8:
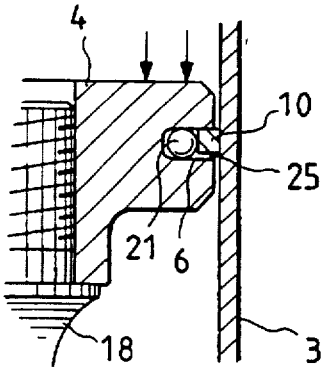
FIG. 8 PRIOR ART
FIG. 8 is a cross-sectional view enlargedly showing a portion "B" of FIG. 7.

In this case, the nail 14 is not completely hit into the wood 15 as shown in FIG. 4. Thus, the piston 4, having moved speedily in the cylinder 3, abruptly stops without being received by the piston bumper 7, and is therefore subjected to a large inertia force.

FIG. 2 shows the piston 4 lowering in the cylinder 3. The piston ring 10, being pressed outward by the O-ring 21, receives a tension acting toward the inside wall of the cylinder 3. Thus, a frictional force is caused between the piston ring 10 and the inside wall of the cylinder 3. Compared with the piston 4 abruptly moving downward upon receiving a large pressure of the introduced air, the piston ring 10 has a smaller area to be subjected to such a pressure. Thus, the piston ring 10 is stationarily positioned at the upper side in the groove 6.

Accordingly, when the piston 4 is abruptly stopped, the piston ring 10 shifts so quickly from the upper side to the lower side in the groove 6 by receiving an inertia moment that the piston ring 10 hardly collides with the lower surface of the groove 6 (i.e. the rigid surface of the aluminum piston 4), causing a large impact force. However, the present invention provides the resilient bumper 11 just beneath the piston ring 10, so as to be deformable when received an impact force. Thus, the piston ring 10 is protected from receiving a large impact force.

Furthermore, as the piston 4 is prevented from being inclined in its thickness direction by providing a smallest radial clearance between the groove 6 and the piston ring 10, it is possible to prevent the driver 18 from receiving an excessive load. In other words, the piston 4 is stably held in the cylinder 3 without causing any of rotation, buckling or damage of the piston ring 10.

Next, when the trigger 2 is released, the control valve 22 is returned to close its opening. Thus, the head valve 5 is lowered so as to close the upper end of the cylinder 3 as shown in FIG. 1. After that, the pressurized air stored outside the cylinder 3 is introduced into a lower space of the cylinder 3 defined beneath the piston 4. Receiving the pressure of the intruduced air, the piston 4 and the driver 18 are returned to the predetermined top dead center of its reciprocative movement, thus completing one cycle of the hammering operation for hitting the nail 14.

At this moment, the nail 14 in the nail guide 13 is hit into the wood 15 by an amount of ⅕ of its entire length. The push lever 8 is still maintained, together with the nail head guide 8*a*, at its raised position by the head of the nail 14. Thus, the trigger 2 is maintained continuously in an unlocked condition.

Accordingly, by pulling the trigger 2 again, the next hammering operation is initiated, thus the hammering operation is repetitively continued until the head of nail 14 reaches the surface of the wood 15. In this manner, the percussion tool, if it has an output power sufficient to completely hit a short nail into a wood by one stroke, can be used to hammer a relatively long nail into a wood by hitting the same plural times. Using such a small and light percussion tool can increase the flexibility in performing the hammering operation in any of horizontal and vertical directions.

Although the above embodiment shows a multi-stroke percussion tool, it is needless to say that the present invention can be employed in a conventionally known single-stroke percussion tool.

Figure 5:
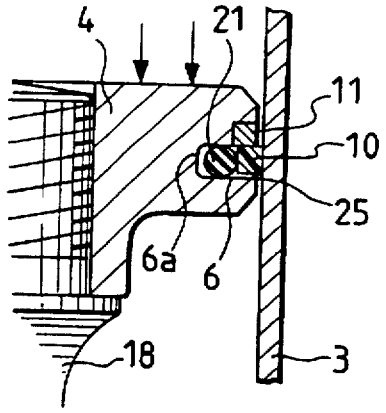
FIG. 5 is a cross-sectional view showing an arrangement of an essential part of a percussion tool in accordance with a second embodiment of the present invention.

FIG. 5 shows an arrangement of a second embodiment of the present invention which is different from the first embodiment in that the bumper 11 is disposed on the piston ring 10, i.e. at an opposite side of the piston ring 10. This bumper 11 absorbs an impact force acting on the piston ring 10 when the piston ring 10 rebounds upward after hitting the lower surface of the groove 6 when the piston 4 is stopped.

Figure 6:
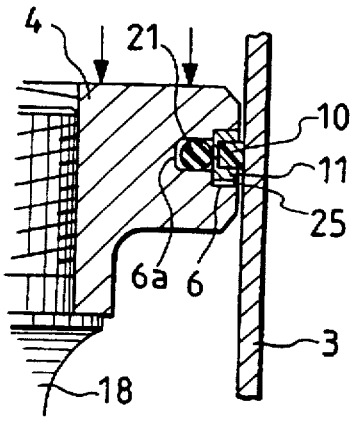
FIG. 6 is a cross-sectional view showing an arrangement of an essential part of a percussion tool in accordance with a third embodiment of the present invention.

FIG. 6 shows an arrangement of a third embodiment of the present invention which is different from the first embodiment in that the bumper 11 is disposed on and beneath the piston ring 10 so as to surround the piston ring 10. In other words, this embodiment is a combination of the above first and second embodiments; thus, the effect of both the first and second embodiments can be brought by this third embodiment only.

Although the above embodiments dispose the O-ring 21 at an inner side of the piston ring 10 so as to apply a significant amount of tension from the O-ring 21 to the piston ring 10, it is possible to replace the O-ring 21 with an appropriate plate tension ring. Alternatively, it is possible to provide a deformable piston ring 10 having an outer diameter larger than the inner diameter of the cylinder 3 so as to resiliently apply a tension from the piston ring 10 to the cylinder 3 without providing the O-ring 21. Or, the bumper 11 can be formed integrally with the O-ring 21. More specifically, a protruding portion acting as the bumper 11 is provided so as to extend outward from the O-ring 21.

As explained in the foregoing description, the present invention provides an elastically deformable ring bumper adjacent to the piston ring in the circular groove of the piston, thereby preventing the piston ring from being damaged by a large inertia or impact force acting thereon when the piston is abruptly stopped in each hammering operation. Thus, the piston ring is prevented from being damaged by a large force, resulting in that the durability of the piston ring is greatly increased. Furthermore, it becomes possible to reduce the piston weight and to increase the piston speed. Thus, an undesirable reaction movement of the percussion force is reduced, and an overall weight of the percussion tool is surely reduced. The piston ring can be made of plastic having a relatively poor durability against an impact force, leading to a large cost decrease of the piston device.

As this invention may be embodied in several forms without departing from the spirit of essential characteristics thereof, the present embodiments as described are therefore intended to be only illustrative and not restrictive, since the scope of the invention is defined by the appended claims rather than by the description preceding them, and all changes that fall within metes and bounds of the claims, or equivalents of such metes and bounds, are therefore intended to be embraced by the claims.

What is claimed is:

1. A piston apparatus for a percussion tool comprising:

a piston slidable in a cylinder of the percussion tool;

a groove recessed on a cylindrical surface of said piston;

a sealing member made of non-elastic material and accommodated in said groove; and a bumper made of elastic material in said groove so that said bumper is interposed between said sealing member and at least one of opposed two walls of said groove in a sliding direction of said piston, said bumper deforming upon receiving an impact force along said sliding direction preventing a large impact force from being exerted on said sealing member by said groove.

2. The piston apparatus defined by claim 1, wherein said sealing member is made of plastic.

3. The piston apparatus defined by claim 1, wherein said bumper is made of a resilient member.

4. The piston apparatus defined by claim 1, wherein said bumper is disposed at one side of said sealing member in said sliding direction of said piston.

5. The piston apparatus defined by claim 1, wherein said bumper is disposed at both sides of said sealing member in said sliding direction of said piston so as to surround said sealing member.

6. A piston apparatus for a percussion tool comprising:

a piston slidable in a cylinder of the percussion tool;

an annular groove recessed on a cylindrical surface of said piston, said cylindrical surface facing an inside wall of the cylinder;

a piston ring made of non-elastic material accommodated in said circular groove, said piston ring providing a hermetical sealing between said piston and said inside wall of the cylinder when said piston is installed in said cylinder; and a bumper made of elastic material formed into a ring shape and provided in said annular groove so that said bumper is interposed between said piston ring and at least one of opposed two sidewalls of said groove in a sliding direction of said piston for reducing an impact force exerted against said piston ring from an impact force along the sliding direction.

7. The piston apparatus defined by claim 6, wherein said piston ring is made of plastic.

8. The piston apparatus defined by claim 6, wherein said bumper is made of a resilient member.

9. The piston apparatus defined by claim 6, wherein said bumper is disposed at one side of said piston ring in said sliding direction of said piston.

10. The piston apparatus defined by claim 6, wherein said bumper is disposed at both sides of said piston ring in said sliding direction of said piston so as to surround said piston ring.

11. A percussion tool comprising:

a cylinder communicated to a pressurized air supply means;

a piston slidable in said cylinder when pressurized air is introduced into said cylinder from said pressurized air supply means and pressure of said pressurized air is applied on said piston;

a groove recessed on a cylindrical surface of said piston, said cylindrical surface facing to an inside wall of said cylinder;

a piston ring made of a non-elastic member accommodated in said groove, so as to provide hermetical sealing between said piston and said cylinder; and a bumper made of elastic material provided in said groove so that said bumper is interposed between said piston ring and at least one of opposed two walls of said groove in a sliding direction of said piston, said elastic bumper deforming from an impact force along said sliding direction preventing a large impact force from being exerted on said non-elastic sealing member.

12. The percussion tool defined by claim 11, wherein said piston ring is made of plastic.

13. The percussion tool defined by claim 11, wherein said bumper is made of a resilient member.

14. The percussion tool defined by claim 11, wherein said bumper is disposed at one side of said piston ring in said sliding direction of said piston.

15. The percussion tool defined by claim 11, wherein said bumper is disposed at both sides of said piston ring in said sliding direction of said piston so as to surround said piston ring.

* * * * *